US006601756B2

(12) United States Patent
Hill et al.

(10) Patent No.: US 6,601,756 B2
(45) Date of Patent: Aug. 5, 2003

(54) ADHESIVE PATTERN FOR A MAILER TYPE BUSINESS FORM INTERMEDIATE

(75) Inventors: Russell E. Hill, Xenia, OH (US); Myrl L. Spencer, Eaton, OH (US)

(73) Assignee: The Standard Register Company, Dayton, OH (US)

( * ) Notice: Subject to any disclaimer, the term of this patent is extended or adjusted under 35 U.S.C. 154(b) by 0 days.

(21) Appl. No.: 09/792,506

(22) Filed: Feb. 23, 2001

(65) Prior Publication Data

US 2001/0048021 A1 Dec. 6, 2001

Related U.S. Application Data

(60) Provisional application No. 60/185,230, filed on Feb. 28, 2000.

(51) Int. Cl.[7] ..... B65D 27/00
(52) U.S. Cl. ..... 229/92.1
(58) Field of Search ..... 229/92.1, 92.3

(56) References Cited

U.S. PATENT DOCUMENTS 5,201,464 A 4/1993 File
5,253,798 A * 10/1993 Lombardo ..... 229/314
5,289,972 A * 3/1994 Sauerwine et al. ..... 229/303
5,294,041 A * 3/1994 Whiteside ..... 229/69
5,633,071 A * 5/1997 Murphy ..... 229/92.1
5,785,242 A 7/1998 Lombardo
5,829,670 A 11/1998 Lombardo et al.
5,950,909 A 9/1999 Peterson et al.
6,003,760 A 12/1999 Ambercrombie
6,015,085 A 1/2000 Cannon et al.
6,039,242 A * 3/2000 Tee ..... 229/92.1
6,126,064 A * 10/2000 Hutchinson ..... 229/313
6,131,802 A * 10/2000 Lombardo ..... 229/92.1
6,196,453 B1 * 3/2001 Hutchinson ..... 229/305
6,309,725 B1 * 10/2001 Peterson et al. ..... 206/390
6,322,106 B1 * 11/2001 Mehta et al. ..... 229/301

* cited by examiner

*Primary Examiner*—Stephen P. Garbe
(74) *Attorney, Agent, or Firm*—Killworth, Gottman, Hagan & Schaeff, LLP

(57) ABSTRACT

An improved adhesive pattern for a mailer type business form intermediate having short and long strips of an adhesive provided offset from each other in removable margin strips on both surfaces of the form intermediate. The short and long adhesive strips alleviate side edge cupping of the removable margin strips, thereby substantially preventing edge crimping of the form intermediate against a retard surface when fed by a friction feeder. Additionally, an adhesive block is provided in each removable margin strip adjacent each of the sheet corners, thereby substantially preventing the corners of the form intermediate from being deflected significantly downward or upward.

4 Claims, 6 Drawing Sheets

ADHESIVE PATTERN FOR A MAILER TYPE BUSINESS FORM INTERMEDIATE

CROSS REFERENCE TO RELATED APPLICATIONS

This application claims the benefit of the following U.S. Provisional Application: Ser. No. 60/185,230 for IMPROVED Z-FOLDABLE BUSINESS FORM, filed Feb. 28, 2000.

BACKGROUND OF THE INVENTION

This invention relates to a mailer type business form intermediate, and more particularly to an improved adhesive pattern for a mailer type business form intermediate which reduces jams in printing machines, particularly high-speed cut sheet laser printers utilized by large mainframe computer systems, where such printers include friction-feed mechanism with retard devices.

In a printer requiring sheet handling to an image transfer station, where an image produced by the printer is transferred to a sheet, such a printer typically includes at least one tray for holding sheets, such as business forms, at least one friction feeder, and at least one retard device. The friction feeder is used to transport single sheets from the sheet tray in an effective and efficient manner. The friction feeder is typically a friction roller or belt which engages a surface of a particular sheet provided in the tray in order to move the sheet along a path leading to the imaging transfer station of the printer. The retard device typically another roller, belt, or pad, provides a retard surface proximate the friction feeder. The retard surface engages the surfaces of other sheets in the tray, preventing them from being transported along with the particular sheet. With such a printer, however, there may be a problem associated with the handling of any cut sheet business form that has strips of adhesive adjacent its leading edge.

FIG. 1 illustrates an exemplary prior-art mailer-type business form intermediate that is z-foldable and that is typically used with a high-speed printer having a fiction feeder and at least one retard surface, such as for example, the DocuPrint 4635 Laser Printing System from Xerox®. Examples of such a mailer intermediate are shown by U.S. Pat. Nos. 5,595,404 and 6,003,760. Generally, the prior art mailer intermediate 100 is a single sheet substrate 102 having front and rear surfaces 101 and 103, top and bottom edges 105 and 107, and side edges 109 and 111. The single sheet substrate 102 is divided into first, second and third sections 104, 106, and 108 by first and second fold lines 110 and 112 that are substantially parallel to the top and bottom edges 105 and 107, and are typically lines of weakness, such as perforation lines. Sections 104, 106, and 108 z-fold against each other along the fold lines 110 and 112.

Additional lines of weakness or perforations 122 are provided adjacently to the side edges 109 and 111, thereby defining removable margin edge portions 113 and 115. A first pattern of a pressure activated cohesive 114, having adhesive strips 116 of equal length, is provided in each margin edge portion 113 and 115 of the first and second sections 104 and 106 on the front surface 101, and in each margin edge portion 113 and 115 of the second and third sections 106 and 108 on the rear surface 103. In order to provide an additional seal for the form intermediate 100, longitudinal strips of a pressure activated cohesive 118*a*, 118*b*, 118*c*, and 118*d* are provided on the front surface 101 adjacent the top edge 105 and the second fold line 112, and on the rear surface 103, adjacent the first folded line 110 and the bottom edge 107, respectively.

The adhesive strips 116 and 118 provided on a front surface 101 of the substrate 102 are illustrated as solid speckled boxes, and those provided on a back surface 103 are illustrated as dashed speckled boxes. With such an adhesive arrangement, however, there is a tendency for the leading edge of the form to be cupped downward by the adhesive strips 116 that extend across the form adjacent to the leading edge. This downward cupping of the leading edge of such form intermediated causes feeding problems in printers with friction feeders and retard surfaces.

In a printer with a friction feeder and a retard surface 62, the retard surface typically engages at around the middle section 106 of the business form 100 when a feed belt or roller of the friction feeder moves the top sheet from a stack of business forms (hereinafter referred to as the picked sheet) in the direction indicated by symbol x. As explained above, the purpose of the retard surface is to prevent feeding more than one sheet at a time, and is typically provided as a roller, pad, or other retard device. Accordingly, the problem associated with the above mentioned adhesive pattern is illustrated by FIG. 2, showing downward cupping of the sheet substrate 102 along section 2—2. As the picked sheet moves in the x direction over the retard surface 62, the leading edge of the sheet substrate 102 in the downwardly cupped section may become crimped or folded downward, since it is still engaged by the retard surface 62, which is indicated by the dashed outline 124. Additionally, due to the cupping effect of the adhesive strips 116, which are provided on the front and rear surfaces 101, 103 proximate the corners of the sheet substrate 102, these corners may come into contact with other surfaces of the processing equipment as they are transported, and may become dog-eared, i.e., deflected up or down, as illustrated in FIG. 1, by downwardly deflected corner 126. These created defects not only detract from appearance of the business form 100, but may also make the form difficult to process through the printer and the folding/sealing/finishing equipment.

Thus, there exists a need to provide an improved mailer type business form intermediate which inhibits paper feeding crimping and dog-earing associated with the transport of mailer type business form intermediates in printers having at least one friction feeder and at least one retard surface.

SUMMARY OF THE INVENTION

The present invention relates to a mailer business form intermediate with an improved adhesive pattern which is suitable for printing machines having at least one friction feeder and at least one retard surface. The adhesive pattern of the present invention may be used with single sheet mailers, or with mailers having two or three built-in removable panels. Additionally, the invention is suitable for use with mailers which are simplex or duplex printed with variable or non-variable information. By variable information, is meant information which varies from mailer to mailer, such as employee names, addresses, and the like. By nonvariable information, is meant information that remains the same from mailer to mailer, such as a return address and standard instructions. The printing may be accomplished with the various automated printers common today, including impact printers, laser printers, thermal transfer printers, ink jet printers, and xerographic machines. The form intermediate is ideally suited for mailing secure documents and information.

Forms according to the present invention may be utilized for a variety of purposes. For instance, the present invention may be employed as a business form wherein the form is printed, folded and placed into a mailing envelope or package. Alternatively, the present invention can be employed as a mailer, whereby the form is printed, folded, and sealed thereby functioning as its own mailing package.

In accordance with one embodiment of the present invention, a form intermediate comprises a substantially quadrate substrate sheet having first and second surfaces, first and second longitudinal edges substantially parallel to each other, and first and second end edges substantially perpendicular to the first and second longitudinal edges. The form intermediate further includes first and second longitudinal lines of weakness formed in the sheet substantially parallel and proximate to the first and second longitudinal edges to define first and second removable margin strips. At least one fold line is formed in the sheet substantially parallel to the first and second end edges, and divides the sheet into sections on opposite sides thereof. An adhesive pattern on the first and second surfaces of the sheet is configured and dimensioned in each of the removable margin strips both to seal the sections together and to prevent significant cupping of the longitudinal edges and corner edge deflection.

In accordance with another embodiment of the present invention, an adhesive pattern for a form intermediate intended to be fed through a printer having at least one friction feeder and at least one retard surface is provided. The form intermediate includes a first surface, a second surface which faces the at least one retard surface, a leading longitudinal edge which interfaces with the friction feeder first, and at least one fold line substantially perpendicular to the leading longitudinal edge dividing the form intermediate into a plurality of panel sections. The adhesive pattern comprises at least one first adhesive strip which extends adjacent the leading longitudinal edge on the first surface a distance longer than the length of the at least one retard surface at least within the plurality of panels proximate the at least one retard surface such that a portion of the at least one first adhesive strip will pass over substantially the complete length of the at least one retard surface when the form intermediate is fed by the at least one friction feeder. The adhesive pattern further comprises at least one second adhesive strip which extends adjacent the leading longitudinal edge on the second surface a distance from the leading longitudinal edge inwards of the at least one first adhesive strip on the first surface at least within the plurality of panel sections proximate the at least one retard surface such that a portion of the at least one second adhesive strip will pass directly over substantially the complete length of the at least one retard surface without the leading longitudinal edge being cupped toward the at least one retard surface when the form intermediate is fed by the at least one friction feeder.

Other advantages and features of the invention will be apparent from the following detailed description, the accompanying drawings, and the appended claims.

BRIEF DESCRIPTION OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENT

Figure 3:
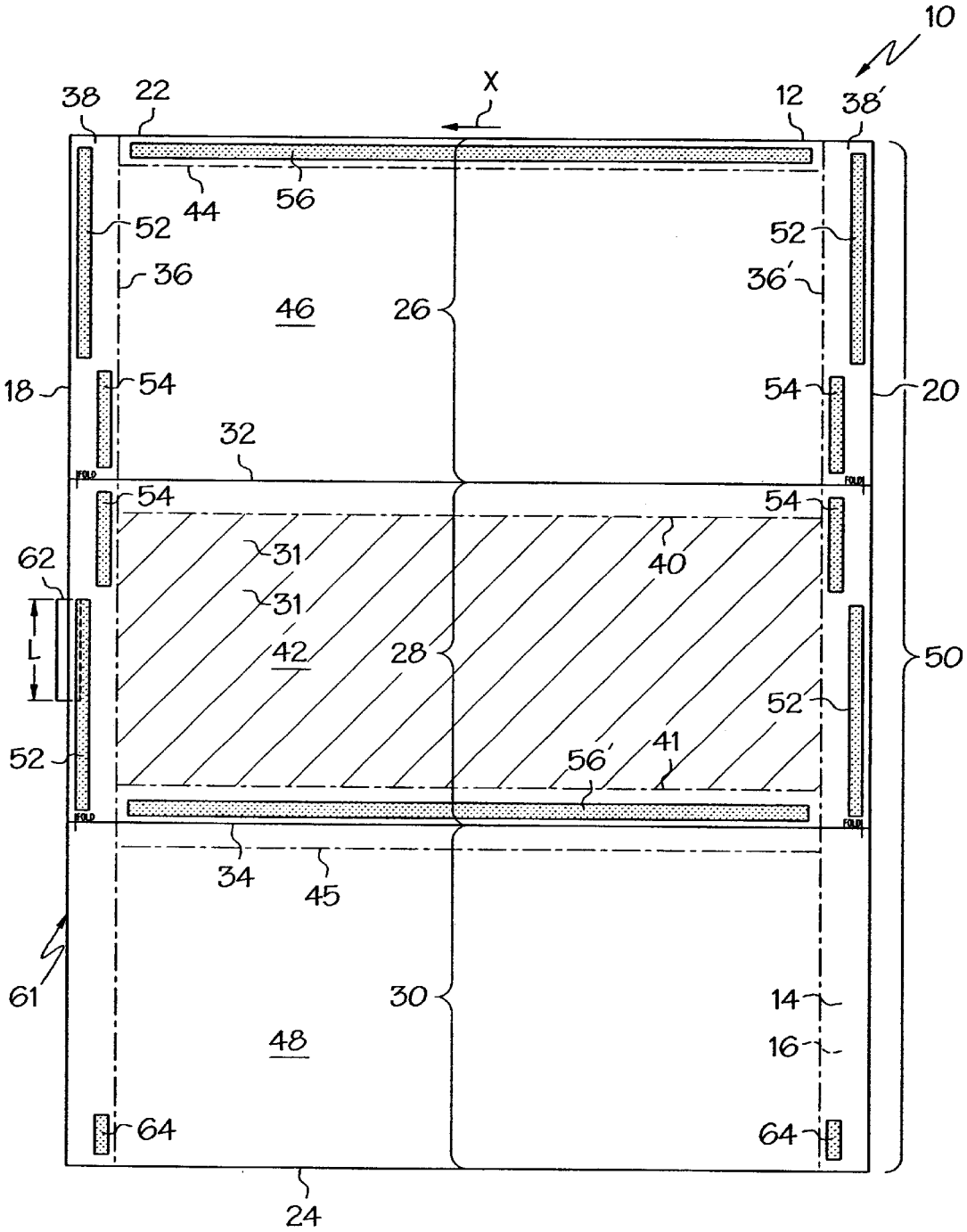
FIG. 3 is a view of the front surface of a business form intermediate of the present invention, showing adhesive locations for a Z-fold arrangement.
Figure 4:
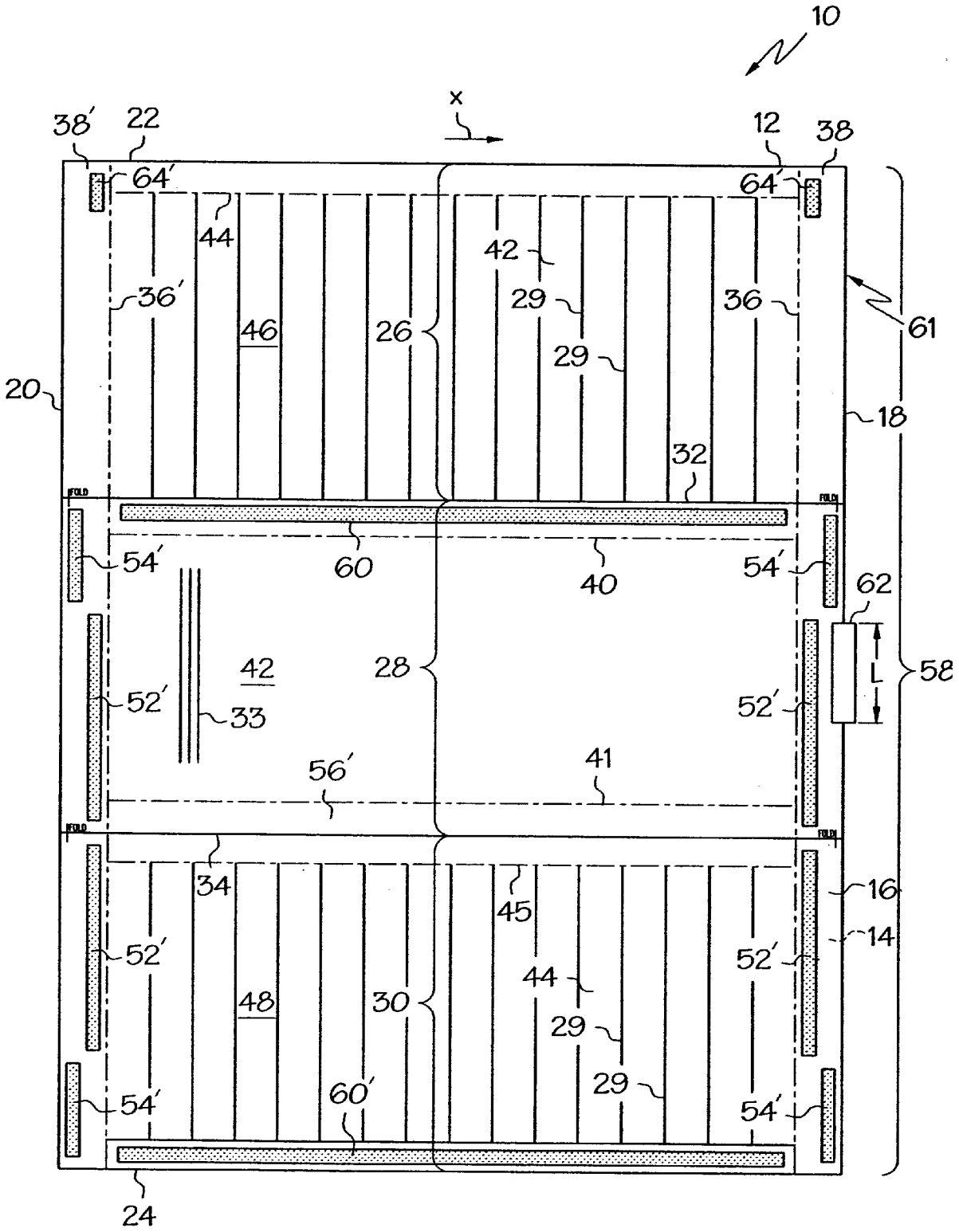
FIG. 4 is a view of the rear surface of the business form intermediate of FIG. 3.

FIGS. 3 and 4 are front and rear views, respectively, of an exemplary unfolded mailer type business form intermediate 10 in accordance with the invention. The form 10 is considered an intermediate since further steps of printing variable information, folding and sealing of the form have yet to be performed.

The form intermediate 10 comprises a substantially quadrate substrate sheet 12 having opposite first and second surfaces 14 and 16, respectively. The intermediate form 10 is preferably rectangular having a first longitudinal edge 18, a second longitudinal edge 20, a first end edge 22 and a second end edge 24. The first and second longitudinal edges 18 and 20 are spaced apart and substantially parallel to each other. The first and second end edges 22 and 24 also are spaced apart, and substantially perpendicular to the first and second longitudinal edges 18 and 20.

Though a variety of size is possible, the substrate sheet 12 is preferably of a standard sheet size, such as 8½ times 11 inches or 8½ times 14 inches to facilitate feeding in standard printers. Additionally, the substrate sheet 12 is preferably a paper product that is of suitable weight and thickness to enable the form intermediate 10 to meet postal regulations. Alternatively, the substrate sheet 12 may be of any known material common in the art for substrate purposes, such as a plastic, a composite, and the like.

Substrate sheet 12 also may be uncoated or coated on one or both of the first and second surfaces 14 and 16. Preferably, substrate sheet 12 is coated on the first surface 14 with a coating that enhances the bonding of toner images from various printers. Known coatings of this type make the image more durable and may impart gloss to the substrate which contributes an aesthetic appearance. Toner adhesion enhancing coatings are also known in the prior art and include those coatings described in U.S. Pat. No. 5,045,426, the disclosure of which is hereby incorporated by reference.

Figure 5:
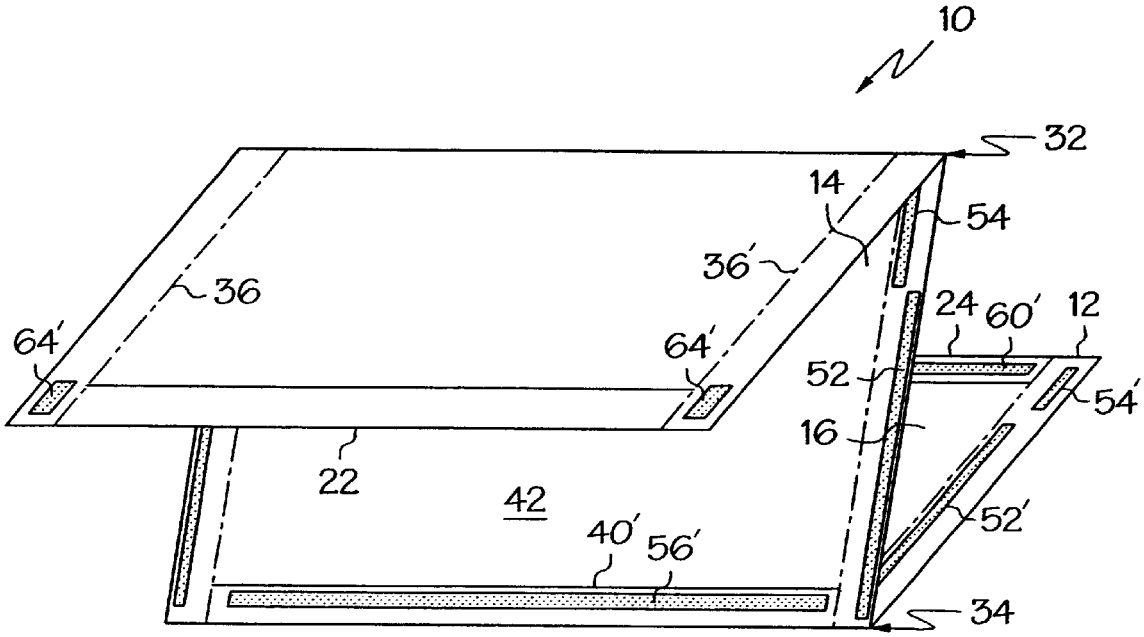
FIG. 5 is a perspective view of the business form intermediate according to the present invention being folded in a Z-fold arrangement.

Substrate sheet 12 is divided into generally equally sized first, second, and third sections 26, 28, and 30 by means of first and second fold lines 32 and 34. The second section 28 is located between the first and third section 26 and 30. Both fold lines 32 and 34 are substantially parallel to end edges 22 and 24, and extend across the width of the form intermediate 10 perpendicular to the first and second longitudinal edges 18 and 20. When the substrate sheet 12 is folded in a Z-fold arrangement, as illustrated by FIG. 5, the first surfaces 14 of the first and second sections 26 and 28 will be in contact, and the second surfaces 16 of the second and third sections 28 and 30 will be in contact.

Sections 26, 28, and 30 may include security features, such as confidential screens and/or anti-fraud protection patterns, to make portions of the form intermediate 10 difficult to reproduce, copy, or read. Such security features are disclosed by U.S. Pat. Nos. 4,210,346, 4,227,720, 4,310,180, 5,197,765, and 5,340,159, and are herein incorporated by reference. Preferably, as shown in FIG. 4, sections 26 and 30 are provided with confidential screening patterns 29 at least on the second surface 16 to prevent information provided on the first surface 14 of section 28 from being read. When configured as a check, section 28 preferably includes endorsing indicia 33. Additionally, as shown in FIG. 3, section 28 preferably includes an anti-fraud protection pattern 31 on at least the first surface 14.

Either of the two fold lines 32 and 34 may be a line of weakness, such as a partial die cut or a line of perforations, to facilitate removal of any of the sections by the user, should that be desired. In this type of arrangement, the first fold line 32 would separate the first section 26 from the second section 28, while the second fold line 34 would separate the second section 28 from the third section 30.

If desired, an address window (not shown) may be provided in one of the outer section 26 or 30. The address window may be covered by any of a number of clear films that are well known in the art to permit an outgoing address to be viewed.

A first and second longitudinal lines of weakness 36 and 35' extend substantially parallel and proximate the first and second longitudinal edges 18 and 20, respectively. Additionally, the longitudinal lines of weakness 36 and 36' extend between the opposing end edges 22 and 24, passing through all of the sections 26,28, and 30, thereby defining first and second removable margin strips 38 and 38'. The margin strips 38 and 38' have a width that is suitable to accommodate an adhesive pattern therein, and is preferably about ½ of an inch.

The intermediate form 10 also includes first and second traverse lines of weakness 40 and 41 provided between the first and second fold lines 32 and 34 to define a removable panel 42 in the second section 28. The panel 42 is particular useful as a security document such as a check. The first and second traverse lines of weakness 40 and 41 are substantially perpendicular to the longitudinal lines of weakness 36 and 36'. A third traverse line of weakness 44 may be provided in first section 26 substantially parallel and proximate the first end edge 22 extending between the longitudinal lines of weakness 36 and 36', thereby defining a second removable panel 46. A fourth traverse line of weakness 45 may be provided in the third section 30 substantially parallel to and proximate the second fold line 34 extending between the longitudinal lines of weakness 36 and 36', thereby defining a third removable panel 48. If so desired, additional information may be provided on the second and third removable panel 46 and 48. It is to be appreciated that the above-mentioned lines of weakness may be either lines of perforations or partial die-cuts, and are used to open and separate the panels after the form intermediate 10 has been folded and sealed.

To seal the form intermediate 10 once it is folded, an adhesive pattern in accordance with the present invention is disposed on both surfaces 14 and 16 of the substrate sheet 12. The adhesive pattern is configured and dimensioned in each of the removable margin strips 38 and 38' both to seal sections of the sheet 12 together and also to reduce the likelihood of cupping along the leading edge of the form or of corner edge deflection of the longitudinal edges 18 and 20 of the sheet 12. In this manner, the adhesive pattern of the present invention substantially prevents crimping of the longitudinal edges 18 and 20 when the form intermediate 10 is fed by a friction feeder into a printer.

For convenience, the adhesive pattern of the present invention is discussed as a first adhesive pattern 50 on the first surface 14, and as a second adhesive pattern 58 on the second surface 16. The adhesive may be a hot-melt/heat-seal adhesive, remoist adhesive, a pressure sensitive adhesive, or pressure activated cohesive, all of which adhesives are well-known in the art.

As shown by FIG. 3, a first adhesive pattern 50 is provided along each of the margin strips 38 and 38' on the first surface 14. The first adhesive pattern 50 is formed of long adhesive strips 52 and short adhesive strips 54. Of course, one of ordinary skill in the art will recognize that certain adhesives, such as pressure seal or self adhesives (sometimes called self-stick adhesives or pressure activated cohesives) require corresponding adhesive patterns opposite and in alignment to each to form a seal. By corresponding adhesive patterns it is meant that the adhesive patterns are arranged for substantial adhesive to adhesive contact when the surfaces are brought together during folding. The first adhesive pattern is arranged such that, when form intermediate 10 is folded about the first fold line 32 to bring the first surfaces of sections 26 and 28 together, the long adhesive strips 52 and the short adhesive strips 54 provided on margin strips 38 and 38' contact their corresponding adhesive strips. First traverse adhesive strip 56 of pressure sensitive adhesive extends along the first end edge 22 between the first end edge 22 and the third traverse line of weakness 44. A second traverse adhesive strip 56' of pressure sensitive adhesive extends across the intermediate 10 between the second traverse line of weakness 41 and the second fold line 34. First traverse adhesive strip 56 contacts and adheres to the second adhesive strip 56' when the substrate sheet 12 is folded about the first fold line 32. Although illustrated as continuous strips, each of the first and second traverse adhesive strips 56, 56' may be each broken into two or more segments.

As illustrated by FIG. 4, the second adhesive pattern 58 is provided on the second surface 16 of the second and third sections 28 and 30, and comprises long adhesive strips 52' and short adhesive strips 54'. The long and short adhesive strips 52', 54' of the second adhesive pattern 58 are provided on margin strips 38 and 38' and are oriented such that, when form intermediate 10 is folded about the second fold line 34, the long adhesive strips 52' and the short adhesive strips 54' align and bond with their respective corresponding adhesive strips. A third traverse adhesive strips 60, extending between the longitudinal lines of weakness 36 and 36', is substantially parallel and adjacent to the fold line 32 on the second section 28. Should a pressure sensitive cohesive be used, then a fourth traverse adhesive strip 60', extending between the longitudinal lines of weakness 36 and 36', may be provided adjacent and substantially parallel to the second end edge 24 such that the third traverse adhesive strip 60 contacts the fourth adhesive strip 60'. Again, although illustrated as continuous strips, each of longitudinal adhesive strips 60, 60' may be each broken into two or more segments.

Figure 1:
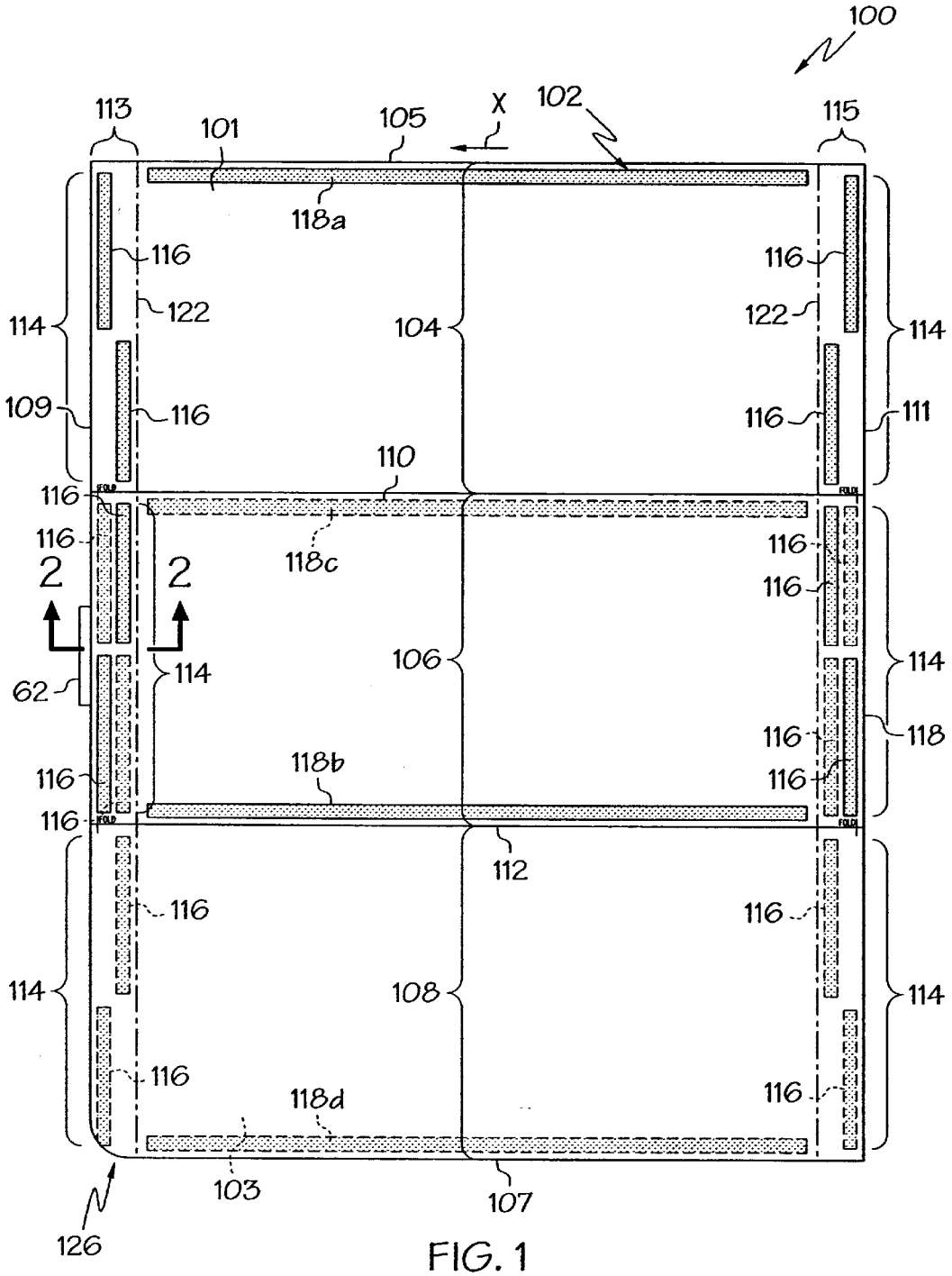
FIG. 1 (PRIOR ART)
FIG. 1 is a view of the front surface of a prior art business form, showing adhesive locations for a Z-fold arrangement.
Figure 2:
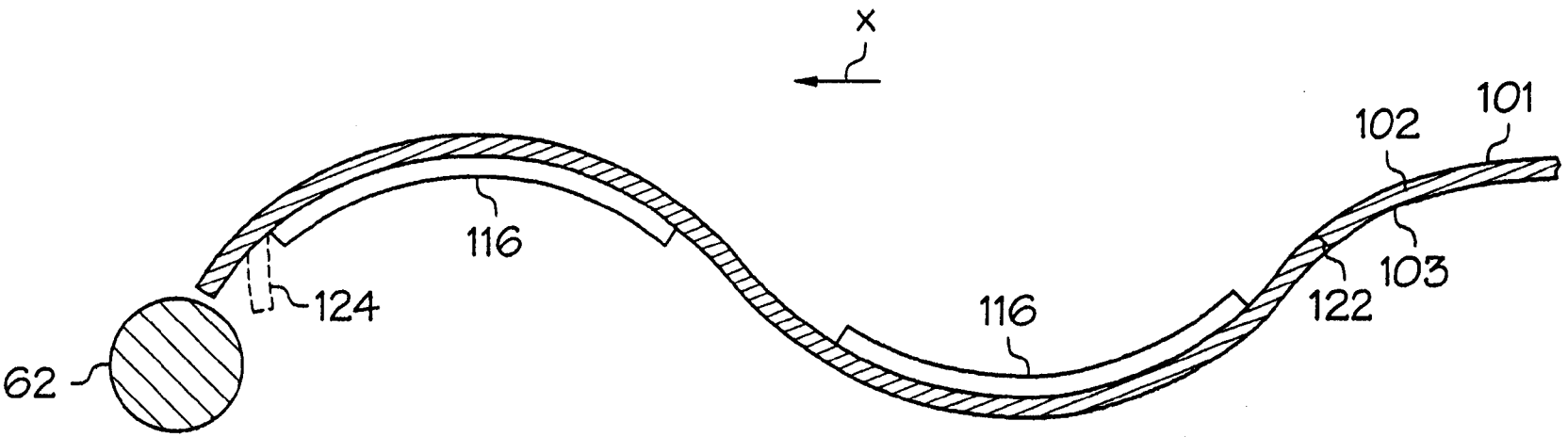
FIG. 2 (PRIOR ART)
FIG. 2 is an enlarged, diagrammatic sectional view of the prior art business form of FIG. 1, taken along section line 2—2.

It is to be appreciated that the arrangement of the long and short adhesive strips 52, 52' and 54, 54' of adhesive patterns 50 and 58, respectively, on the first and second surfaces of the substrate sheet 12 is such that downward cupping of the portion of the leading edge 61 of the form intermediate 10 which contacts the retard surface 62 is minimized. As a consequence, crimping of the leading edge 61 of the intermediate 10 is also minimized, and handling of the substrate sheet 12 is facilitated. This is accomplished by extending the long adhesive strips 52, 52' provided to the form intermediate 10 a distance longer than the length L of the retard surface 62, and positioning the long adhesive strips 52, 52' on the form intermediate 10 such that the portion of each of the long adhesive strips 52, 52' that is equal to the length L of the retard surface 62 passes over the full length L of the retard surface 62 when fed by the friction feeder. In addition, the cupping effect is further minimized by staggering or offsetting, relative to each other, the long and short adhesive strips 52, 52' and 54, 54', and positioning the long adhesive strip 52' adjacent the leading edge 61 on section 28 back from the edge. In other words, and as best shown by FIG. 4, on the second surface 16 of the substrate 12, the long adhesive strips 52' provided in the margin strips 38 are positioned from about 4/16 to about 5/16 of an inch away from the edges 61 of the substrate sheet 12. In this manner, the adhesive strips 52' on the second surface 16, which in the prior art caused the downward cupping of a portion of the form's leading edge 61 as illustrated by in FIGS. 1 and 2, is effectively moved away from the edge 61. Adhesive strip 52 on the opposite surface of the panel 42 (FIG. 3) is closer to the edge 61. However, adhesive strip 52 will tend to make the edge 61 curl upward, thus also tending to prevent the edge 61 from catching on the retard surface 62 and crimping. Accordingly, this position for adhesive strips 52' substantially prevents crimping of the edge 61 when fed through a printer having a friction feeder and a retard surface since edge 61 is not cupped downward significantly.

To prevent the comers of the substrate sheet 12 from deflecting significantly either upward or downward, adhesive blocks 64 are provided within the margin strips 38 and 38' on the first surface 14, substantially adjacent end edge 24. Additionally, on the second surface 16, adhesive blocks 64' are provided within the margin strips 38 and 38', substantially adjacent end edge 22. Adhesive blocks 64 and 64' are not provided to act as adhesive, and in this regard to not align with other adhesive-covered areas when the form intermediate 10 is folded. Rather adhesive blocks 64 and 64' are positioned at the corners of the form intermediate to balance the cupping that would other wise result from the strips of adhesive on the opposite sides of the form adjacent those corners. For example, adhesive blocks 64 provide cupping which effectively counterbalances the cupping that adhesive strips 54' produce on the opposite side of the form. Similarly, adhesive blocks 64' provide cupping which effectively counterbalances the cupping that adhesive strips 52 produce on the opposite side of the form. Blocks 64 and 64' do not eliminate cupping, they merely minimize its deleterious effects by keeping the intermediate form flatter in the region of its corners. This facilitates the travel of the form intermediate through various sheet processing devices where there may be limited paper path clearance. To prevent sticking, none of the adhesive strips 52, 52', 54, 54', 56, 56', 60, 60' and adhesive blocks 64, 64' coincide with any other adhesive when the form intermediate 10 is stacked flat with other identical form intermediates.

Although the above illustrated exemplary form intermediate 10 is a three-section z-fold form intermediate, it should be apparent to those persons skilled in the related art that a similar pattern to the adhesive patterns 50 and 58 of the present invention may be easily applied to other types of mailer-type business form intermediates, such as those that may be either v-fold, c-fold, or the like.

Figure 6:
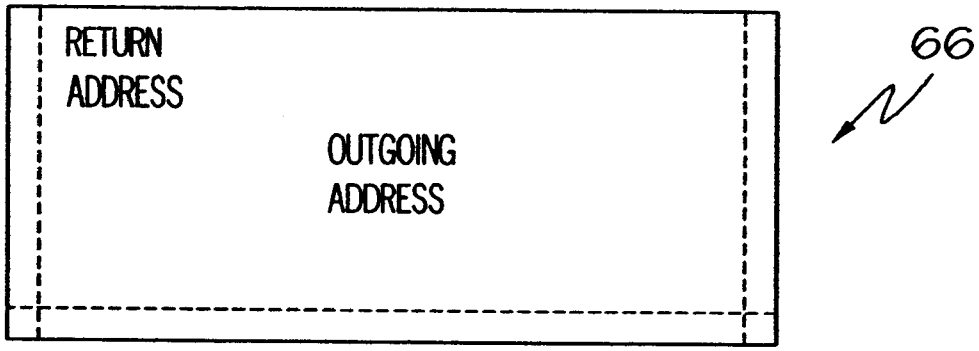
FIG. 6 is a front view of a folded and sealed mailer according to the present invention; and, FIG. 7 is a schematic block diagram illustrating the various method steps that may be utilized with a business form intermediate according to the present invention.
Figure 7:
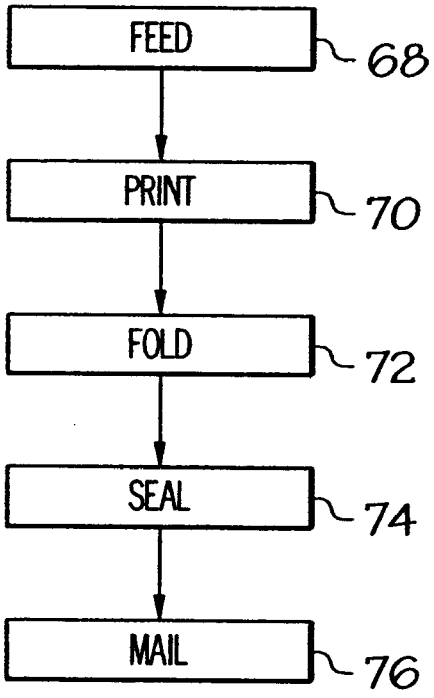

The basic method of use of the forms and form intermediates of the type to which the present invention is directed is schematically illustrated in FIGS. 5, 6, and 7. In step 68, the form intermediate 10 containing pre-printed, non-varying information is fed through a printer having at least one friction feeder and at least one retard surface. In step 70, variable information such as the address information and perhaps text, is printed on one or both surfaces 14 and 16. A variety of such printers can be used including impact printers and non-impact printers (such as laser printers).

Thereafter, in step 72, the form 10 is transported and folded at a folding stage. The folding of the form 10 is illustrated in FIG. 5. Form 10 is folded about the first fold line 32, bringing the first surfaces 14 of the first and second sections 26 and 28 together. The form 10 is also folded about the second fold line 34, bringing the second surfaces 16 of the second and third sections 28 and 30 together. Next, in step 74, at a sealing stage the folded form 10 is sealed along the adhesive segments. The folding and sealing stages can be incorporated in the same piece of conventional equipment. The resulting folded and sealed mailer 10 (illustrated in FIG. 6) is now ready for distribution, such as being mailed, as illustrated schematically in step 76.

It will thus be seen that according to the present invention an exemplary mailer type business form intermediate, and method of utilization thereof, to produce imaged mailers, have been provided which are advantageous compared to the prior art. Cupping of the longitudinal edges (e.g., 18 and 20), which cause edge crimping of the form intermediate both during imaging through a printer or subsequent folding, is substantially eliminated by the intermediate construction of the present invention. This is also accomplished according to the invention without introducing any unnecessary complications into the system.

While the invention has been herein shown and described in what is presently conceived to be the most practical and preferred embodiment thereof it will be apparent to those of ordinary skill in the art that many modifications may be made thereof, within the scope of the invention, which scope is to be accorded the broadest interpretation of the appended claims so as to encompass all equivalent products and methods.

What is claimed is:

1. A form intermediate having a first surface, a second surface which faces a retard surface, a leading longitudinal edge which interfaces wit at least one friction feeder first, at least one fold line substantially perpendicular to the leading longitudinal edge dividing the form intermediate into a plurality of panel sections, and an adhesive pattern, the form intermediate intended to be fed through a printer having said at least one friction feeder and said retard surface of a length, the adhesive pattern comprising:

at least one first adhesive strip which extends adjacent the leading longitudinal edge on the first surface a distance longer than the length of the retard surface such that a portion of the at least one first adhesive strip will pass over substantially the complete length of the retard surface when the form intermediate is fed by the at least one friction feeder; and at least one second adhesive strip which extends adjacent the leading longitudinal edge on the second surface a distance from the leading longitudinal edge inwards of the at least one first adhesive strip on the fast surface such that a portion of the at least one second adhesive strip will pass directly over substantially the complete length of the retard surface without the leading longitudinal edge being cupped toward the retard surface when the form intermediate is fed by the at least one friction feeder, wherein said retard surface is positioned to contact the center of the leading longitudinal edge.

2. The adhesive pattern as recited in claim 1, further comprising:

at least one third adhesive strip which extends adjacent the leading edge on the first surface at least within the plurality of panel sections that are proximate the at least one retard surface, the at least one third adhesive strip is provided offset from the at least one first adhesive strip; and at least one fourth adhesive strip which extends adjacent the leading edge on the second surface at least within the plurality of panel sections that are proximate the at least one retard surface, the at least one fourth adhesive strip is provided offset from the at least one second adhesive strip.

3. The adhesive pattern as recited in claim 2, further comprising:

a block of adhesive provided adjacent each corner of the form intermediate on a surface opposite that on which adhesives are provided, whereby the corners of the sheet are substantially prevented from being deflected significantly downward or upward.

4. The adhesive pattern as recited in claim 3, wherein the block of adhesive does not align with another adhesive strip to form a cohesive bond when the form intermediate is folded.

* * * * *

UNITED STATES PATENT AND TRADEMARK OFFICE

CERTIFICATE OF CORRECTION

PATENT NO. : 6,601,756 B2
DATED : August 5, 2003
INVENTOR(S) : Hill et al.

It is certified that error appears in the above-identified patent and that said Letters Patent is hereby corrected as shown below:

Column 5,
Line 27, reads “35’ extend” should read -- 36’ extend --

Column 7,
Line 29, reads “prevent the comers” should read -- prevent the corners --

Column 8,
Line 42, reads “interfaces wit at” should read -- interfaces with at --

Column 10,
Lines 1-8, reads “The adhesive pattern as recited in claim 2, further comprising:a block of adhesive provided adjacent each corner of the form intermediate on a surface opposite that on which adhesives are provided, whereby the corners of the sheet are substantially prevented from being deflected significantly downward or upward.” should read -- The adhesive pattern as recited in claim 1, further comprising on each surface:a block of adhesive provided adjacent the leading edge approximate a corner of the form intermediate at which adhesive strips are not provided. --

Signed and Sealed this

Sixth Day of April, 2004

JON W. DUDAS
*Acting Director of the United States Patent and Trademark Office*